US007102607B2

(12) United States Patent
Minami

(10) Patent No.: US 7,102,607 B2
(45) Date of Patent: Sep. 5, 2006

(54) LIQUID CRYSTAL DRIVING DEVICE

(75) Inventor: Akihiro Minami, Kumamoto (JP)

(73) Assignee: Kabushiki Kaisha Advanced Display, Kumamoto (JP)

( * ) Notice: Subject to any disclaimer, the term of this patent is extended or adjusted under 35 U.S.C. 154(b) by 184 days.

(21) Appl. No.: 10/303,067

(22) Filed: Nov. 25, 2002

(65) Prior Publication Data

US 2003/0098838 A1 May 29, 2003

(30) Foreign Application Priority Data

Nov. 26, 2001 (JP) ..... P2001-358824

(51) Int. Cl.
*G09G 3/36* (2006.01)

(52) U.S. Cl. ..... 345/96; 345/87; 345/98; 345/99; 345/204

(58) Field of Classification Search ..... 345/7, 345/77–84, 87, 90, 96, 98–99, 100–101, 345/204
See application file for complete search history.

(56) References Cited

U.S. PATENT DOCUMENTS 6,404,889 B1 * 6/2002 Ryan et al. ..... 380/201
6,515,646 B1 * 2/2003 Tokonami et al. ..... 345/96
6,600,469 B1 * 7/2003 Nukiyama et al. ..... 345/87
6,704,056 B1 * 3/2004 Kitahara et al. ..... 348/458
6,778,170 B1 * 8/2004 Shu et al. ..... 345/213
2003/0052852 A1 3/2003 Oohira

FOREIGN PATENT DOCUMENTS

JP 11231843 A * 8/1999
JP 2003-091266 A 3/2003
KR 10-2000-0066091 A 11/2000
KR 10-2000-0069091 A 11/2000
KR 10-2001-0065766 A 7/2001

* cited by examiner

*Primary Examiner*—Richard Hjerpe
*Assistant Examiner*—Leonid Shapiro
(74) *Attorney, Agent, or Firm*—McDermott Will & Emery LLP

(57) ABSTRACT

A liquid crystal driving device that supplies control signals including at least a polarity inversion signal for AC driving to an image signal line driving circuit, the polarity inversion signal includes polarity inversion pulses varied periodically at a prescribed period even in vertical blanking intervals. The last polarity inversion pulses at the last cycles in each of vertical blanking intervals are deleted.

8 Claims, 5 Drawing Sheets

LIQUID CRYSTAL DRIVING DEVICE

BACKGROUND OF THE INVENTION

1. Field of the Invention

The present invention relates to a liquid crystal driving device that supplies control signals for AC driving to an image signal line driving circuit even in vertical blanking intervals.

2. Description of the Related Art

In general, a liquid crystal panel is configured in such a manner that image signal lines (source lines) and scanning signal lines (gate lines) are arranged in matrix form and liquid crystal cells are formed so as to correspond to the respective crossing points of the image signal lines and the scanning signal lines. The image signal lines are driven by an image signal line driving circuit and the scanning signal lines are driven by a scanning signal line driving circuit.

It is known to supply control signals to the image signal line driving circuit in vertical blanking intervals as well as in vertical scanning intervals, which is an effective measure for preventing horizontal-line-dependent unevenness in an image display on the display screen. In liquid crystal driving devices using this measure, control signals are supplied to the image signal line driving circuit in vertical blanking intervals as well as in vertical scanning intervals. The control signals are signals for AC-driving the image signal lines varied periodically at a prescribed period corresponding to the period of a horizontal sync signal. The cotrol signals include a polarity inversion signal, a data shift start pulse signal, and a latch pulse signal.

Conventional circuits that supply control signals to the image signal line driving circuit in vertical blanking intervals as well as in vertical scanning intervals are required to satisfy the following two conditions. First, in vertical blanking intervals, control signals should be supplied at a period that is the same as or close to their period in vertical scanning intervals. Second, in vertical blanking intervals, a horizontal sync signal should be supplied at a period that is the same as or close to its period in vertical scanning intervals.

If the first and second conditions are not satisfied, that is, the periods of the control signals and the horizontal sync signal in a vertical blanking interval become much different than in the preceding vertical scanning interval, portions of the control signals at the last cycle of the vertical blanking interval may cause an erroneous operation in a control in the next vertical scanning interval. Such an erroneous operation may also occur when the length of a vertical blanking interval has been varied by one horizontal period or an odd time of less than one horizontal period.

SUMMARY OF THE INVENTION

An object of the present invention is to provide an improved liquid crystal driving device in which no erroneous operation occurs in a display operation in the next vertical scanning interval even if the periods of control signals and a horizontal sync signal in a vertical blanking interval become much different than in the preceding vertical scanning interval or the length of a vertical blanking interval has been varied by one horizontal period or an odd time of less than one horizontal period.

The invention provides a liquid crystal driving device which supplies control signals including at least a polarity inversion signal for AC driving to an image signal line driving circuit, the polarity inversion signal includes polarity inversion pulses varied periodically at a prescribed period even in vertical blanking intervals, wherein the last pulses of the polarity inversion pulses at the last cycles in each of vertical blanking intervals are deleted.

The invention also provides a liquid crystal driving device which supplies control signals including at least a polarity inversion signal for AC driving to an image signal line driving circuit, the polarity inversion signal includes polarity inversion pulses varied periodically at a period corresponding to a period of a horizontal sync signal even in vertical blanking intervals, wherein the last polarity inversion pulses of the polarity inversion pulses at the last cycles in each of vertical blanking intervals are deleted.

According to the invention, since the last pulse of the polarity inversion pulses at the last cycles in each of vertical blanking intervals are deleted, an erroneous operation that would otherwise be caused by the last polarity inversion pulses can be prevented effectively.

Specifically, the invention is effective in the case where the control signals are supplied to an image signal line driving circuit in a vertical blanking interval with different timing than in the preceding vertical scanning interval. In this case, the deletion of the last polarity inversion pulse prevents an erroneous operation from occurring in the next vertical scanning interval.

The invention is also effective in the case where pulses of a horizontal sync signal have different timing in a vertical blanking interval than in the preceding vertical scanning interval or a partial deviation exists between the two kinds of timing to form timing that has an odd duration of less than one horizontal period in the last cycle of the vertical blanking interval. Also in this case, the last polarity inversion pulses at the last cycles having an odd duration of less than one horizontal period are deleted, whereby an erroneous operation can be prevented from occurring in the next vertical scanning interval.

The invention is also effective when the length of the horizontal blanking interval or the vertical blanking interval has been varied intentionally or for a certain reason. Also in this case, the polarity inversion signals having an odd duration of less than one horizontal period occurs at the end of a vertical blanking intervals. However, the polarity inversion pulses at the last cycles having an odd duration of less than one horizontal period are deleted according to the invention, whereby an erroneous operation can be prevented from occurring in the next vertical scanning interval.

DESCRIPTION OF THE PREFERRED EMBODIMENTS

EMBODIMENT 1

Figure 1:
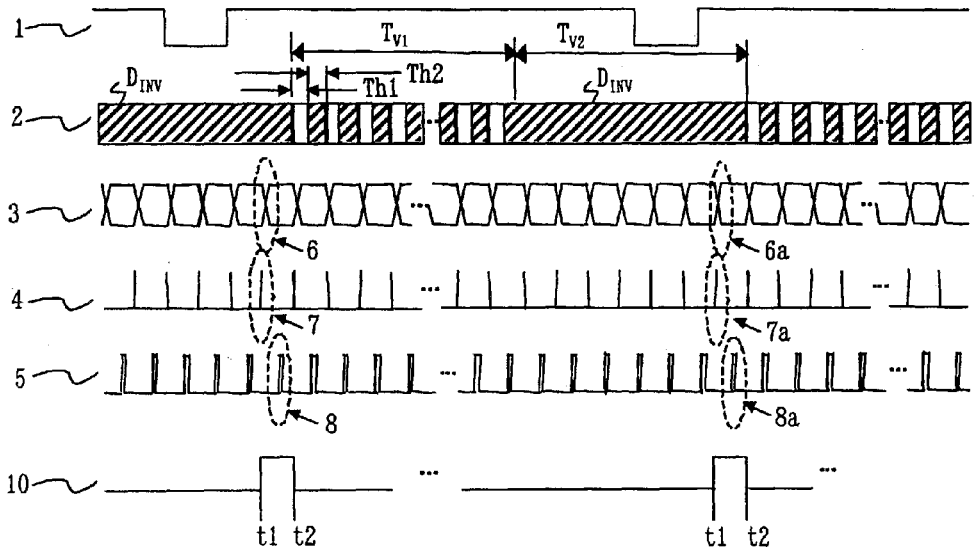
FIG. 1 PRIOR ART
FIG. 1 shows various signal waveforms in a case that control signals in the last cycles of each of vertical blanking intervals are not deleted.
Figure 2:
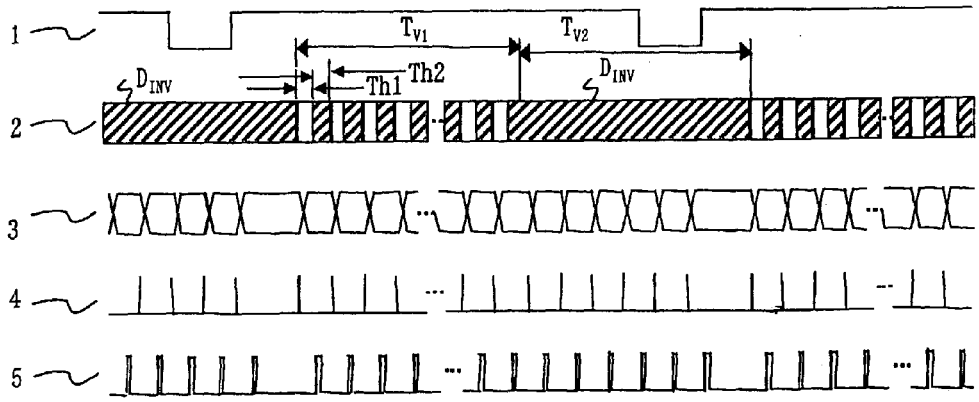
FIG. 2 shows signal waveforms in a liquid crystal driving device according to the present invention in which control signals in the last cycles of each of vertical blanking intervals are deleted.

FIGS. 1 and 2 show how various signal wave forms of a liquid crystal driving device according to the present invention are improved. FIG. 1 shows signal waveforms in a case that control signals that vary at a prescribed period include last pulses at the last cycles in each of vertical blanking intervals. FIG. 2 shows signal waveforms in a case that last pulses that would otherwise exist at the last cycles in each of vertical blanking intervals are deleted from control signals that vary at a prescribed period.

In FIGS. 1 and 2, reference numeral 1 denotes a vertical sync signal (Sv) and reference numeral 2 denotes an image data signal (Di). The vertical sync signal (Sv) 1 has a period Tv=Tv1+Tv2, where Tv1 is a vertical scanning period and Tv2 is a vertical blanking period. The vertical scanning period Tv1 includes a prescribed number of horizontal periods Th. The horizontal period Th is given by Th1+Th2, where Th1 is a horizontal scanning period and Th2 is a horizontal blanking period. Hatched portions of the image data signal (Di) 2 indicate image data in uneffective display periods. The image data signal (Di) 2 has invalid data $D_{INV}$ in vertical blanking intervals Tv2 and horizontal blanking intervals Th2.

Reference numerals 3–5 denote a polarity inversion signal, a data shift start pulse signal, and a latch pulse signal, respectively. The signals 3–5 are control signals Ss that are supplied to the image signal line driving circuit. The image signal lines (source lines) of the liquid crystal panel are AC-driven in degrees corresponding to respective image signals based on the control signals Ss. More specifically, the polarity inversion signal 3 is a reference signal to be used for converting pixel to be applied to the liquid crystal of the liquid crystal panel into AC voltages. The data shift start pulse signal 4 is a pulse signal to be used for causing the image signal line driving circuit to start capturing pixel data. The latch pulse signal 5 is a pulse signal to be used for outputting pixel data that have been captured by the image signal line driving circuit to the liquid crystal panel.

According to the invention, in each of vertical blanking intervals Tv2, partially deleted control signals Ssm that are different from the control signals Ss in that last cycle pulses are deleted are supplied to the image signal line driving circuit. The control signals Ss are supplied to the image signal line driving circuit in each of vertical scanning intervals Tv1 and the partially deleted control signals Ssm are supplied to the image signal line driving circuit in each of vertical blanking intervals Tv2. The control signals Ssm are signals that vary periodically at a prescribed period that is, for example, equal to the horizontal period Th, and they vary in the same prescribed period as the control signals Ss in the vertical scanning intervals Tv1 even in the vertical blanking intervals Tv2. The control signals Ssm, which are supplied in each of vertical blanking intervals, are effective in preventing horizontal-like-dependent unevenness in an image display on the liquid crystal panel.

In FIG. 1, last pulses, which exist at the last cycles in each of vertical blanking intervals Th2, that is, the last pulses which correspond to the last cycles in each of vertical blanking intervals Tv2 for the control signals Ssm, of the control signals Ssm that vary periodically are denoted by 6–8 or 6*a*–8*a*. The last pulses 6 and 6*a* are last pulses of the polarity inversion signal 3. The last pulses 7 and 7*a* are last pulses of the data shift start pulse signal 4. The last pulses 8 and 8*a* are last pulses of the latch pulse signal 5.

According to the invention, as shown in FIG. 2, the last pulses 6, 6*a*, 7, 7*a*, 8, and 8*a* are deleted (control signals Ssm). This is done by using masking signals (Sm) 10 shown in FIG. 1. In each masking signal (Sm) 10, a pulse occurs at the last cycle in each of vertical blanking intervals Tv2 for the control signals Ssm, and is used for deleting the last pulses 6, 6*a*, 7, 7*a*, 8, and 8*a*. FIG. 2 shows the control signals Ssm include the polarity inversion signal 3, the data shift start pulse signal 4 and the latch pulse signal 5 from which the last pulses 6, 6*a*, 7, 7*a*, 8 and 8*a* have been deleted.

More specifically, a time point t1 when each of masking signals (Sm) 10 rises is timed with the start of the last cycle of the associated vertical blanking interval Th2 and a time point t2 when each of the masking signals (Sm) 10 falls is timed with the start of the next vertical scanning interval Th1. Deleting the last pulses 6, 6*a*, 7, 7*a*, 8, and 8*a* using the masking signals (Sm) 10 that rise and fall at the respective time points t1 and t2 provides the following advantages.

First, even if the control signals Ssm are supplied to the image signal line driving circuit in a vertical blanking interval Tv2 with different timing than in the preceding vertical scanning interval Tv1, an erroneous operation can be prevented from occurring in the next vertical scanning interval Tv1 because the last pulses 6, 6*a*, 7, 7*a*, 8, and 8*a* at the last cycle in the vertical blanking interval Tv2 are deleted.

An erroneous operation can also be prevented from occurring in the next vertical scanning interval Tv1 even if pulses of the horizontal sync signal Sh have different timing in a vertical blanking interval Tv2 than in the preceding vertical scanning interval Tv1 or a partial deviation exists between the two kinds of timing to form timing that has an odd duration of less than one horizontal period Th at the last cycle in the vertical blanking interval Tv2. In this case, the last cycle comes to have an odd duration that is less than one horizontal period Th. However, the last control signal pulses 6, 6*a*, 7, 7*a*, 8, and 8*a* at the last cycle having an odd duration of less than one horizontal period Th are deleted, whereby an erroneous operation can be prevented from occurring in the next vertical scanning interval Tv1.

The deletion of the last pulses 6, 6*a*, 7, 7*a*, 8, and 8*a* is also effective when the length of the horizontal blanking interval Th2 or the vertical blanking interval Tv2 has been varied intentionally or for a certain reason. Also in this case, an odd duration of less than one horizontal period Th occurs at the end of each vertical blanking interval Tv2. However, the last pulses 6, 6*a*, 7, 7*a*, 8, and 8*a* of control signals at the last cycle having an odd duration of less than one horizontal period Th are deleted according to the invention, whereby an erroneous operation can be prevented from occurring in the next vertical scanning interval Tv1.

Figure 3:
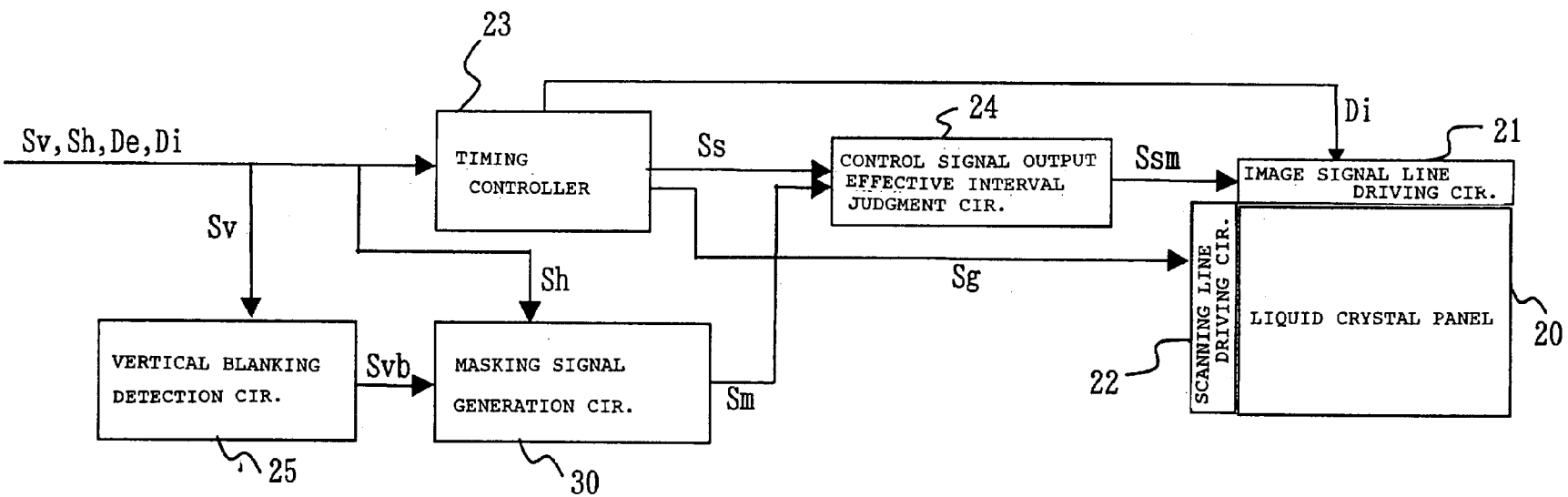
FIG. 3 is a block diagram showing a liquid crystal driving device according to a first embodiment of the invention.

FIG. 3 is a block circuit diagram showing a liquid crystal driving device according to a first embodiment of the invention. The liquid crystal driving device has a liquid crystal panel 20, which has image signal lines (source lines) extending in the vertical direction, for example, and scanning signal lines (gate lines) extending in the horizontal direction, for example. Pixels that constitute the liquid crystal panel 20 are arranged so as to correspond to the crossing points of the image signal lines and the scanning signal lines.

The liquid crystal panel 20 also has an image signal line driving circuit 21 and a scanning signal line driving circuit 22. Incorporating a source driver IC, the image signal line driving circuit 21 drives the image signal lines of the liquid crystal panel 20. For example, in the liquid crystal panel 20, the image signal lines extend in the vertical direction and are arranged at prescribed intervals. The image signal line driving circuit 21 supplies image signals of magnitudes corresponding to a video signal to the respective image signal lines according to an AC driving scheme. Image signals for the respective image signal lines have values obtained by sampling the video signal in order in a horizontal scanning interval Th1. The scanning signal line driving circuit 22 sequentially drives the scanning signal lines, which extend in the horizontal direction of the liquid crystal panel 20 and are arranged at prescribed intervals, according to a horizontal sync signal Sh that is included in the video signal.

The liquid crystal driving device also has a timing controller 23, which is supplied with a vertical sync signal (Sv) 1, a horizontal sync signal Sh, a data enable signal De, and an image data signal (Di) 2. Based on these signals, the timing controller 23 generates image signal line driving control signals Ss for the image signal line driving circuit 21 and scanning line driving control signals Sg for the scanning line driving circuit 22. The image signal line driving control signals Ss are supplied to a control signal output effective interval judgment circuit 24. The image data signal (Di) 2 is supplied from the timing controller 23 to the image signal line driving circuit 21.

The liquid crystal driving device also has a vertical blanking detection circuit 25 and a masking signal generation circuit 30. The vertical blanking detection circuit 25 receives the vertical sync signal (Sv) 1 and generates a vertical blanking detection signal Svb. The masking signal generation circuit 30 receives the vertical blanking detection signal Svb and the horizontal sync signal Sh and generates a masking signal (Sm) 10, which is supplied to the control signal output effective interval judgment circuit 24. Using the masking signal (Sm) 10, the control signal output effective interval judgment circuit 24 generates a partially deleted control signals Ssm that lack signals partially and supplies those to the image signal line driving circuit 21. The partially deleted control signals Ssm are different from the control signals (Ss) 10 in that the last pulses 6, 6*a*, 7, 7*a*, 8, and 8*a* at the last cycles in each of vertical blanking intervals Tv2 are deleted.

Figure 4:
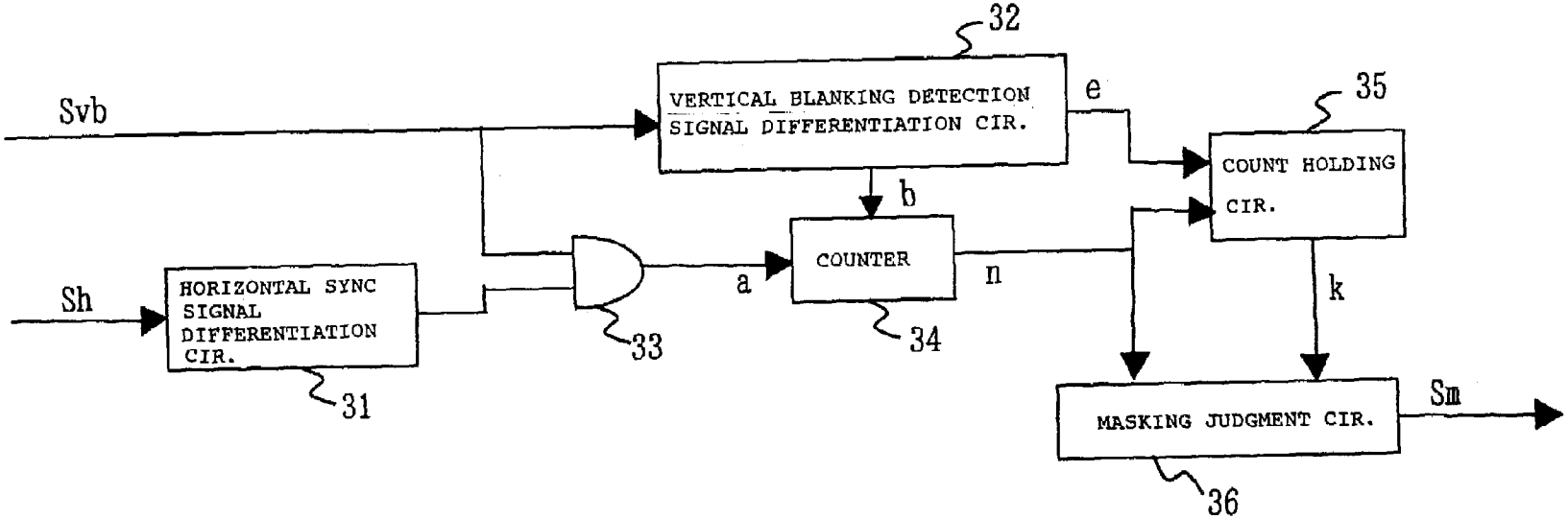
FIG. 4 is a block diagram showing a masking signal generation circuit that is used in the liquid crystal driving device of FIG. 3.

FIG. 4 is a block circuit diagram showing an exemplary specific circuit configuration of the masking signal generation circuit 30. The masking signal generation circuit 30 has a horizontal sync signal differentiation circuit 31, a vertical blanking detection signal differentiation circuit 32, an AND gate 33, a counter 34, a count holding circuit 35, and a masking judgment circuit 36. For example, the vertical blanking detection signal Svb is a signal that becomes a high level at the start of each vertical blanking interval Tv2. The counter 34 receives a differentiation signal a of the horizontal sync signal Sh from the AND gate 33 in each vertical blanking interval Tv2 and counts pulses of the differentiation signal a. A resulting count is represented by n. The horizontal sync signal differentiation circuit 31 outputs differentiation pulses of only rising edges of the horizontal sync signal Sh.

The vertical blanking detection signal differentiation circuit 32 resets the counter 34 by supplying a reset signal b to the counter 34 at the end of each vertical blanking interval Tv2, in other words, at the start of the next vertical scanning interval Tv1. The vertical blanking detection signal differentiation circuit 32 also causes the count holding circuit 35 to hold, as a last count, a count k that was effective immediately before the resetting of the counter 34 by supplying a counter enable signal e to the count holding circuit 35 at the end of each vertical blanking interval Tv2. The count k is held until occurrence of the next counter enable signal e. The masking judgment circuit 36 receives the count k that is held by the count holding circuit 35 and the count n that is supplied from the counter 34, and generates a pulse of a masking signal (Sm) 10 if $n \geqq k$.

Figure 5:
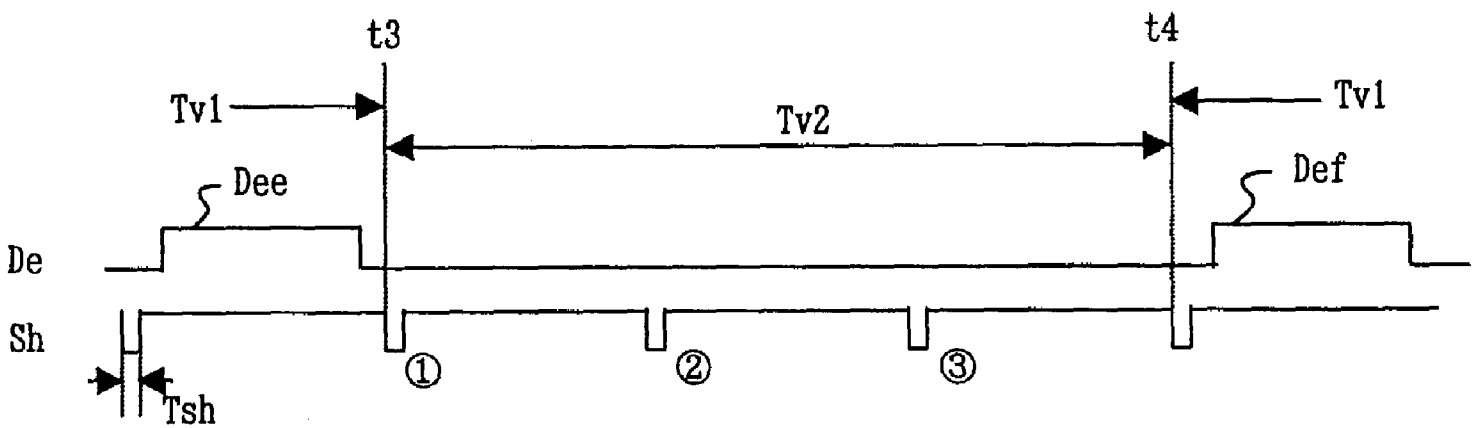
FIG. 5 illustrates each vertical blanking interval in the liquid crystal driving device of FIG. 3.

As shown in FIG. 5, each vertical blanking interval Tv2 is an interval from the end time t3 of the preceding vertical scanning interval TV1 to the start time t4 of the next vertical scanning interval TV1. More specifically, the end time t3 is a time point when the pulse of the horizontal sync signal Sh falls that immediately follows the last pulse Dee of the data enable signal De in the preceding vertical scanning interval Tv1. The start time t4 is a time point when the first pulse of the horizontal sync signal Sh in the next vertical scanning interval Tv1 falls. As seen from FIG. 5, in each vertical blanking interval Tv2, the counter 34 counts differentiation pulses that occur when the horizontal sync signal Sh rises. A resulting count n is equal to the number of horizontal cycles included in the vertical blanking interval Tv2. Therefore, usually, the condition $n \geqq k$ of the masking judgment circuit 36 is satisfied at the last horizontal cycle in the vertical blanking interval Tv2 and a pulse of the masking signal (Sm) 10 is generated at the last horizontal cycle. In FIG. 5, symbol Tsh represents the duration of each pulse of the horizontal sync signal Sh. Although FIG. 5 is drawn in a simplified manner as if the vertical blanking interval Tv2 included only three pulses ①, ②, and ③ of the horizontal sync signal Sh, actually the vertical blanking interval Tv2 include more pulses of the horizontal sync signal Sh. The pulses ① and ③ should be recognized as corresponding to the first cycle and the last cycle, respectively, in the vertical blanking interval Tv2.

In the masking signal generation circuit 30 of FIG. 4, the count k that is held by the count holding circuit 35 is updated every vertical blanking interval Tv2 and the masking judgment circuit 36 performs a judgment operation in the next vertical blanking interval Th2 based on such a count k. Therefore, even if the timing of the control signals Ss in a certain vertical blanking interval Th2 has varied, an ordinary judgment operation is performed in the next vertical blanking interval based on the varied timing of the control signals Ss.

EMBODIMENT 2

Figure 6:
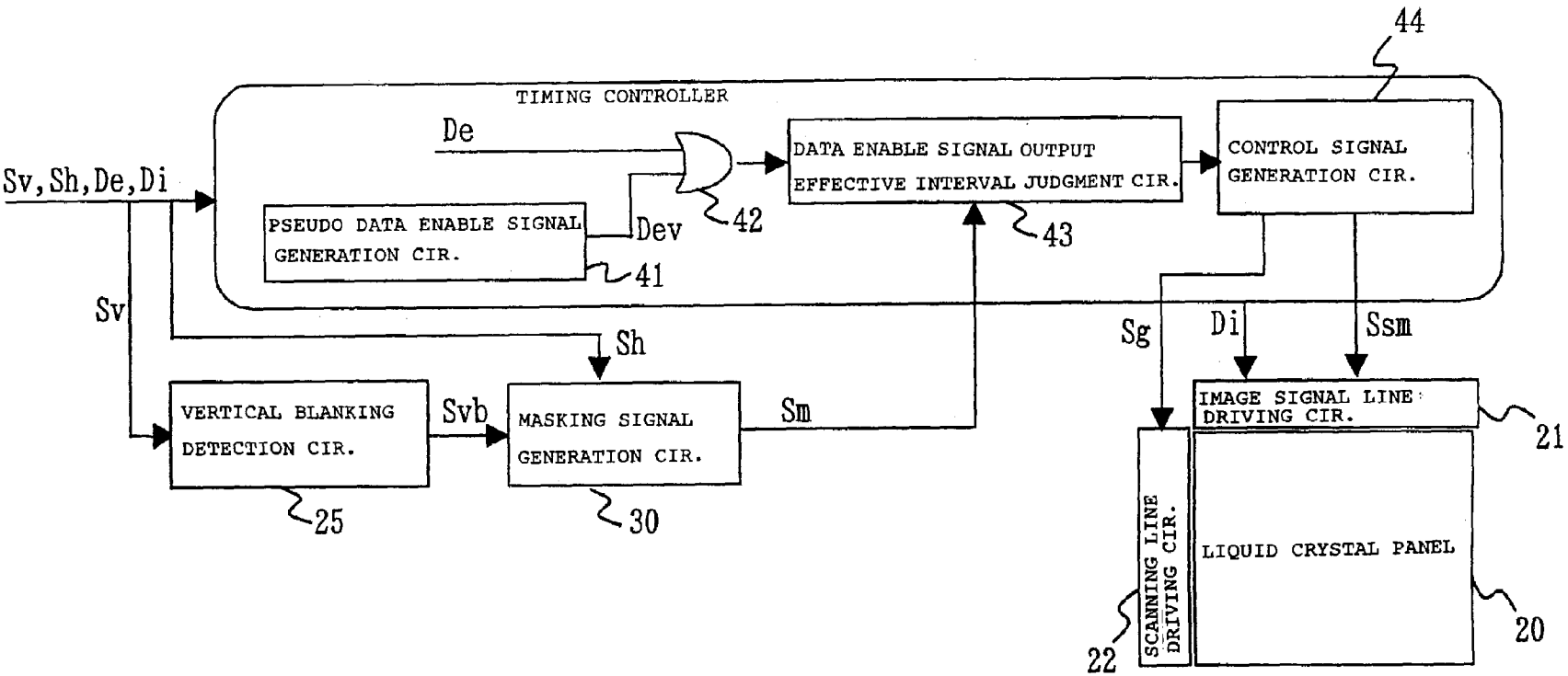
FIG. 6 is a block diagram showing a liquid crystal driving device according to a second embodiment of the invention.

FIG. 6 is a block diagram showing a liquid crystal driving device according to a second embodiment of the invention. This liquid crystal driving device employs a timing controller 40 that is different from the timing controller 23 shown in FIG. 3. The vertical blanking detection circuit 25 is configured in the same manner as that shown in FIG. 3. The masking, signal generation circuit 30 is configured in the same manner as shown in FIG. 4.

The timing controller 40 shown in FIG. 6 has a pseudo data enable signal generation circuit 41, an OR circuit 42, a data enable signal output effective interval judgment circuit 43, and a control signal generation circuit 44.

In the timing controller 40 shown in FIG. 6, in each vertical blanking interval Tv2 the pseudo data enable signal generation circuit 41 generates a pseudo data enable signal Dev, which is supplied to the data enable signal output effective interval judgment circuit 43 via the OR circuit 42 together with a data enable signal De that is generated in the next vertical scanning interval Tv1. The data enable signal output effective interval judgment circuit 43 is also supplied with a masking signal Sm from the masking signal generation circuit 30. Using the masking signal Sm, the data enable signal output effective interval judgment circuit 43 deletes a portion of the pseudo data enable signal Dev in the last cycle of each vertical blanking interval Tv2. The last-cycle-deleted pseudo data enable signal Dev and the data enable signal De are supplied to the control signal generation circuit 44. The control signal generation circuit 44 supplies the image signal line driving circuit 21 with control signals Ssm, that is, a polarity inversion signal 3 in which last pulses 6 and 6*a* are deleted, a data shift start pulse signal 4 in which last pulses 7 and 7*a* are deleted, and a latch pulse signal 5 in which last pulses 8 and 8*a* are deleted (see FIG. 2). Further, the control signal generation circuit 44 supplies control signals Sg to the scanning line driving circuit 22. An image data signal Di is supplied from the timing controller 40 to the image signal line driving circuit 21.

According to the second embodiment shown in FIG. 6, the generation of the control signals Ssm can be simplified by generating the pseudo data enable signal Dev in advance.

As described above, according to the invention, since the polarity inversion pulses at the last cycles in each of vertical blanking intervals are deleted, an erroneous operation can be prevented from occurring due to the polarity inversion pulses at last cycles having an odd duration.

In the configuration in which last polarity inversion pulses are deleted by using the masking signals, the last pulses of the plural kinds of control signal pulses can be deleted simultaneously in an effective manner. In the configuration in which the masking signal is supplied to the effective interval judgment circuit, the last polarity inversion pulses can be deleted reliably by the effective interval judgment circuit. In the configuration in which the effective interval judgment circuit is provided between the timing controller and the image signal line driving circuit, last polarity inversion pulses can be deleted reliably at the final stage of the image signal line driving.

In the configuration in which the effective interval judgment circuit is provided in the enable signal supply circuit, the generation of the control signals can be simplified by generating the pseudo data enable signal in each vertical blanking interval. In the configuration in which the number of pulses of the horizontal sync signal is counted in each vertical blanking interval, control signal pulses in the last cycle of each vertical blanking interval can be deleted in such a manner as to accommodate a variation in the number of pulses of the horizontal sync signal in the vertical blanking interval.

What is claimed is:

1. A liquid crystal driving device which supplies control signals including at least a polarity inversion signal for AC driving to an image signal line driving circuit, the polarity inversion signal including polarity inversion pulses varied periodically at a prescribed cycle period even in vertical blanking intervals, wherein the polarity inversion pulse at only the last one cycle period in each of the vertical blanking intervals is deleted.

2. A liquid crystal driving device which supplies control signals including at least a polarity inversion signal for AC driving to an image signal line driving circuit, the polarity inversion signal including polarity inversion pulses varied periodically at a cycle period corresponding to a period of a horizontal sync signal even in vertical blanking intervals, wherein the polarity inversion pulse at only last the one cycle period in each of vertical blanking intervals is deleted.

3. The liquid crystal driving device according to claim 2, comprising a masking signal generation circuit for generating a masking signal pulse at the last cycle period in each of vertical blanking intervals, wherein the polarity inversion pulse at only the last one cycle period in each of vertical blanking intervals is deleted by using the masking signal pulse.

4. The liquid crystal driving device according to claim 3, comprising an effective interval judgment circuit for receiving the masking signal pulse and for deleting the polarity inversion pulse at only the last one cycle period in each of vertical blanking intervals.

5. The liquid crystal driving device according to claim 4, wherein the effective interval judgment circuit is provided between a timing controller and the image signal line driving circuit and deletes the polarity inversion pulse at only the last one cycle period in each of vertical blanking intervals from the timing controller.

6. The liquid crystal driving device according to claim 4, wherein the effective interval judgment circuit is provided in a circuit for supplying an enable signal to a circuit for generating image signal line driving signals and scanning line driving signals.

7. The liquid crystal driving device according to claim 6, wherein the effective interval judgment circuit is provided in a circuit for supplying the enable signal and a pseudo enable signal.

8. The liquid crystal driving device according to claim 3, wherein the masking signal generation circuit counts pulses of the horizontal sync signal in each of vertical blanking intervals and generates the masking signals based on resulting counts.

* * * * *